US011624255B1

(12) United States Patent
Le

(10) Patent No.: US 11,624,255 B1
(45) Date of Patent: Apr. 11, 2023

(54) ROTATING CONTROL DEVICE WITH DEBRIS-EXCLUDING BARRIER

(71) Applicant: WEATHERFORD TECHNOLOGY HOLDINGS, LLC, Houston, TX (US)

(72) Inventor: Tuong T. Le, Katy, TX (US)

(73) Assignee: WEATHERFORD TECHNOLOGY HOLDINGS, LLC., Houston, TX (US)

( * ) Notice: Subject to any disclaimer, the term of this patent is extended or adjusted under 35 U.S.C. 154(b) by 0 days.

(21) Appl. No.: 17/722,568

(22) Filed: Apr. 18, 2022

(51) Int. Cl.
*E21B 33/08* (2006.01)

(52) U.S. Cl.
CPC ..... *E21B 33/085* (2013.01)

(58) Field of Classification Search
CPC ..... E21B 33/085
See application file for complete search history.

(56) References Cited

U.S. PATENT DOCUMENTS

| | | | | |
|---|---|---|---|---|
| 4,500,094 | A * | 2/1985 | Biffle | E21B 33/085 285/365 |
| 5,383,549 | A * | 1/1995 | Mayer | F16C 35/063 384/480 |
| 6,206,182 | B1 * | 3/2001 | Wilson | B65G 39/09 198/842 |
| 7,487,837 | B2 | 2/2009 | Bailey et al. | |
| 8,631,863 | B2 * | 1/2014 | Heckel | E21B 33/1208 166/242.6 |
| 8,678,084 | B2 * | 3/2014 | Heckel | E21B 33/1208 166/242.6 |
| 8,714,240 | B2 | 5/2014 | Bailey et al. | |
| 8,794,313 | B2 * | 8/2014 | Heckel | E21B 41/00 166/242.6 |
| 9,624,733 | B2 * | 4/2017 | Fleetwood | E21B 12/06 |
| 9,845,653 | B2 | 12/2017 | Hannegan et al. | |
| 10,215,282 | B1 * | 2/2019 | Taylor | F16J 15/4476 |
| 10,294,722 | B2 * | 5/2019 | Foerster | F16J 15/4476 |
| 10,494,877 | B2 | 12/2019 | Barela | |
| 10,697,276 | B2 | 6/2020 | Mcmullen | |
| 10,914,131 | B2 * | 2/2021 | Chau | E21B 23/006 |
| 2018/0058169 | A1 | 3/2018 | Le | |
| 2020/0181980 | A1 | 6/2020 | Wheeler | |
| 2020/0182006 | A1 | 6/2020 | Dietrich et al. | |
| 2020/0208471 | A1 | 7/2020 | Mcmullen et al. | |

FOREIGN PATENT DOCUMENTS

KR 20140039794 A * 4/2014

* cited by examiner

*Primary Examiner* — Matthew R Buck
(74) *Attorney, Agent, or Firm* — Smith IP Services, P.C.

(57) ABSTRACT

A rotating control device can include a bearing housing, an inner mandrel rotatably supported in the bearing housing, and a barrier having upper and lower portions, the upper portion being secured against rotation relative to the inner mandrel, the lower portion being secured against rotation relative to the bearing housing, the lower portion including annular recesses, the recesses being progressively deeper in a radially outward direction. Another barrier can include upper and lower portions, the lower portion including multiple annular walls, an upper surface of each wall being inclined downward in a radially outward direction. Another barrier can include upper and lower portions, the upper and lower portions having annular walls, the upper portion walls being interdigitated with the lower portion walls, and the upper and lower portion walls being circumferentially discontinuous, whereby gaps are formed between circumferential ends of the upper and lower portion walls.

16 Claims, 6 Drawing Sheets

ROTATING CONTROL DEVICE WITH DEBRIS-EXCLUDING BARRIER

BACKGROUND

This disclosure relates generally to equipment utilized and operations performed in conjunction with a subterranean well and, in an example described below, more particularly provides a barrier suitable for excluding debris from a rotary seal of a rotating control device.

A rotating control device (sometimes alternately referred to as a rotating blowout preventer, rotary diverter or rotating control head) is used in some well operations to seal off an annulus formed between an outer housing and a tubular positioned in the rotating control device. An annular seal of the rotating control device seals against the tubular and rotates with the tubular.

It will be appreciated that improvements are continually needed in the art of designing, constructing and utilizing rotating control devices. The present specification provides such improvements, which may be used in a variety of different well operations.

DETAILED DESCRIPTION

Figure 1:
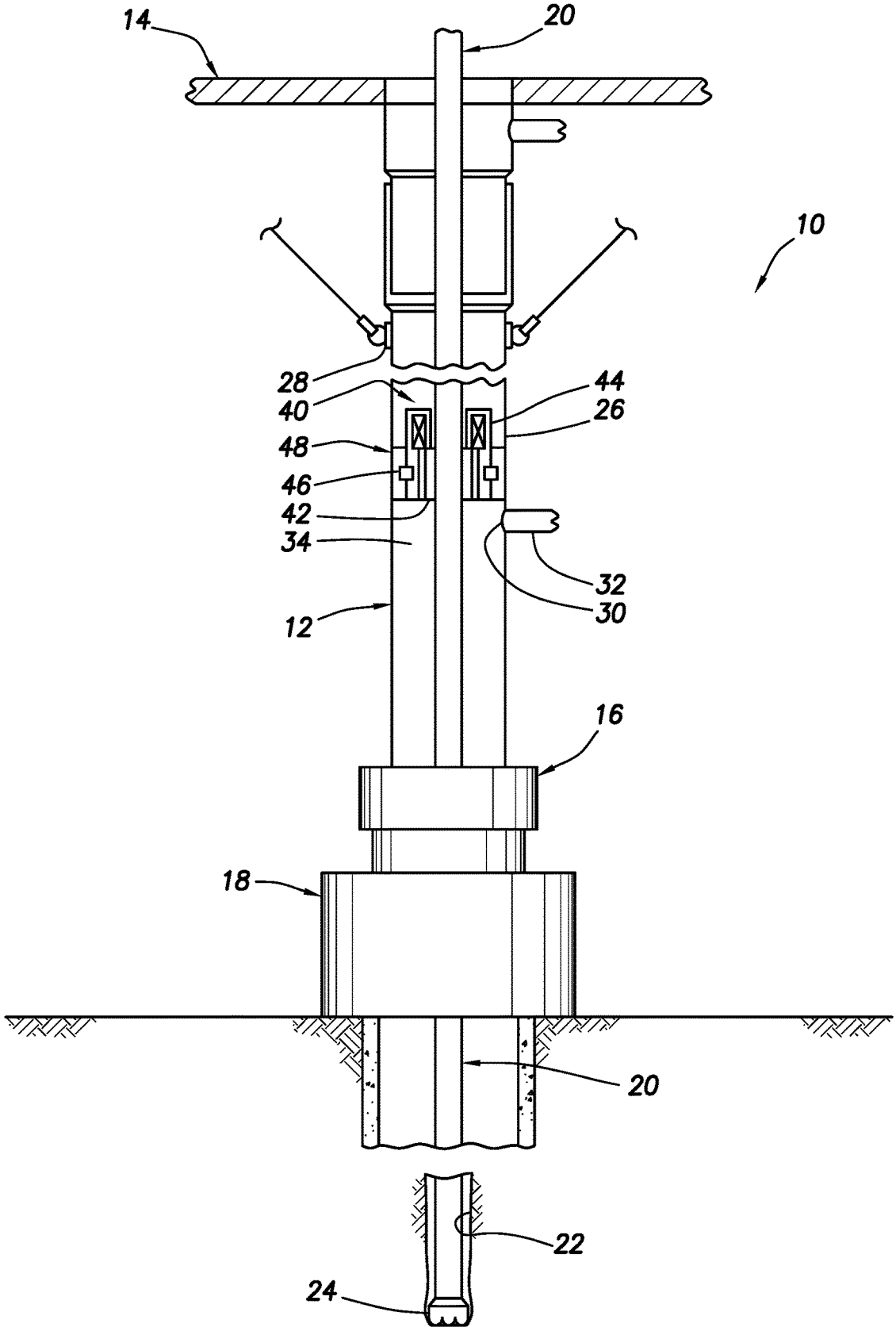
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method as described herein and/or depicted in the drawings.

In the system 10 as depicted in FIG. 1, a generally tubular riser string 12 extends between a water-based rig 14 and a lower marine riser package 16 above a subsea wellhead installation 18 (including, for example, various blowout preventers, hangers, fluid connections, etc.). However, in other examples, the principles of this disclosure could be practiced with a land-based rig, or with a riser-less installation.

In the FIG. 1 example, a tubular string 20 (such as, a jointed or continuous drill string, a coiled tubing string, etc.) extends through the riser string 12 and is used to drill a wellbore 22 into the earth. For this purpose, a drill bit 24 is connected at a lower or distal end of the tubular string 20.

The drill bit 24 may be rotated by rotating the tubular string 20 (for example, using a top drive or rotary table of the rig 14), and/or a drilling motor (not shown) may be connected in the tubular string 20 above the drill bit 24. However, the principles of this disclosure could be utilized in well operations other than drilling operations. Thus, it should be appreciated that the scope of this disclosure is not limited to any of the details of the tubular string 20 or wellbore 22 as depicted in the drawings or as described herein.

The riser string 12 depicted in FIG. 1 includes an outer housing assembly 26 connected in the riser string 12 below a tensioner ring 28 suspended from the rig 14. In other examples, the outer housing assembly 26 could be connected above the tensioner ring 28, or could be otherwise positioned (such as, in the wellhead installation 18 in a riser-less configuration). Thus, the scope of this disclosure is not limited to any particular details of the riser string 12 or outer housing assembly 26 as described herein or depicted in the drawings.

The outer housing assembly 26 includes a side port 30 that provides for fluid communication between a conduit 32 and an annulus 34 formed radially between the riser string 12 and the tubular string 20. In a typical drilling operation, drilling fluid can be circulated from the rig 14 downward through the tubular string 20, outward from the drill bit 24, upward through the annulus 34, and return to the rig 14 via the conduit 32.

As depicted in FIG. 1, a rotating control device 40 is installed in the outer housing assembly 26. The rotating control device 40 and the outer housing assembly 26 together comprise a pressure control device 48.

In the FIG. 1 example, the rotating control device 40 includes one or more annular seals 42 that seal off the annulus 34 above the side port 30. In this example, the annular seals 42 are configured to sealingly engage an exterior of the tubular string 20. The annular seals 42 may be of a type known to those skilled in the art as "passive," "active" or a combination of passive and active. The scope of this disclosure is not limited to use of any particular type of annular seal.

Rotation of the annular seals 42 relative to the outer housing assembly 26 is provided for by bearings 44 of the rotating control device 40. The annular seals 42 and bearings 44 are releasably secured in the outer housing assembly 26 by a latch assembly 46. The latch assembly 46 permits the annular seals 42 and/or the bearings 44 to be installed in, or retrieved from, the outer housing assembly 26 when desired, for example, to service or replace the seals 42 and/or bearings 44.

Various components of the latch assembly 46 may be part of, or integral to, the outer housing assembly 26, the rotating control device 40, or a combination thereof. The scope of this disclosure is not limited to any particular location(s) or configuration of any components or combination of components of the latch assembly 46.

Figure 2:
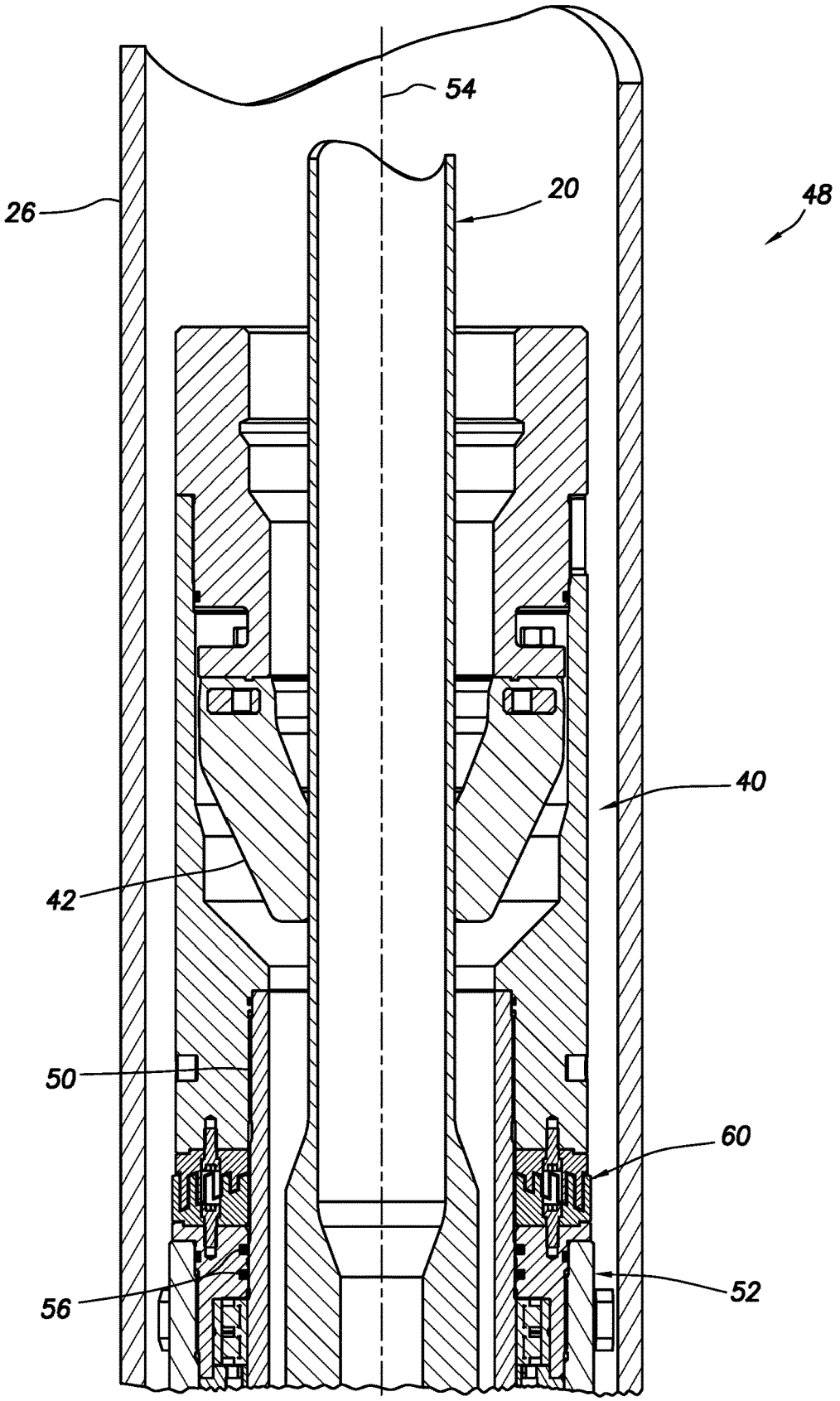
FIG. 2 is a representative cross-sectional view of an example of an upper portion of a rotating control device that can incorporate the principles of this disclosure.

Referring additionally now to FIG. 2, a cross-sectional view of an example of an upper portion of the rotating control device 40 is representatively illustrated. The rotating control device 40 is depicted in FIG. 2 as installed in the outer housing 26 of the pressure control device 48 in the system 10 and method of FIG. 1, but it should be understood that the rotating control device may be used with other systems and methods in keeping with the principles of this disclosure.

In the FIG. 2 example, an upper annular seal 42 of the rotating control device 40 is secured to a generally tubular inner mandrel 50. The inner mandrel 50 is rotatably supported within a bearing housing 52, which encloses the bearings 44 (see FIG. 1). Thus, the annular seal 42 and the inner mandrel 50 can rotate together relative to the bearing housing 52.

In operation, the annular seal 42 seals against and frictionally grips an outer surface of the tubular string 20. When the tubular string 20 rotates, the annular seal 42 and the inner mandrel 50 rotate with the tubular string about a longitudinal axis 54 of the rotating control device 40.

One or more rotary seals 56 seal against an outer surface of the inner mandrel 50. The rotary seals 56 isolate the bearings 44 and lubricant in the bearing housing 52 from well fluids and debris in the outer housing 26. However, it is possible for debris and abrasive well fluids to damage the rotary seals 56, which can then lead to contamination of the bearing lubricant and eventual failure of the bearings 44.

To prevent or at least delay such damage to the rotary seals 56, the rotating control device 40 includes a barrier 60. The barrier 60 is configured to exclude debris and particulates from contact with the rotary seals 56.

Figure 3:
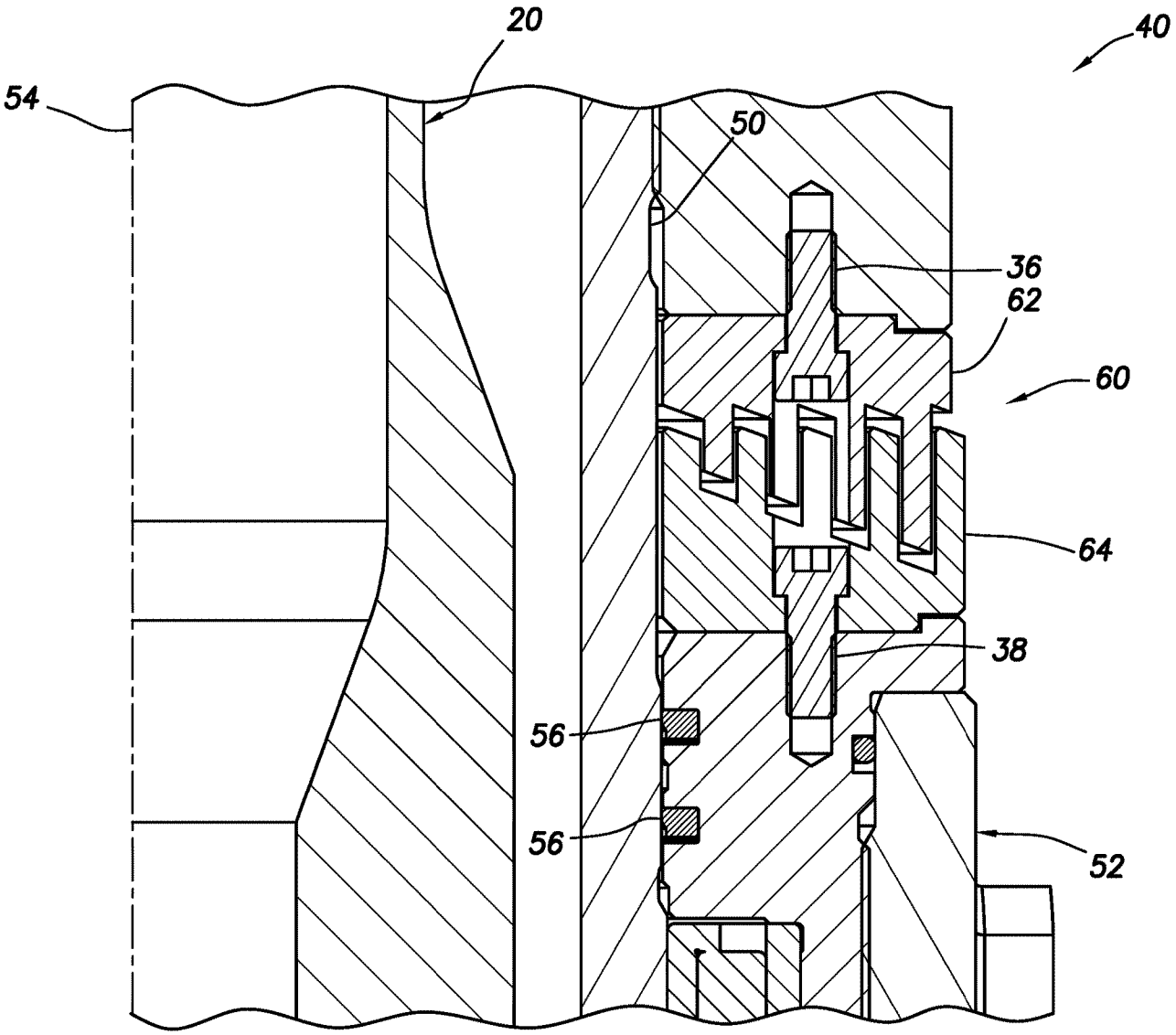
FIG. 3 is a representative cross-sectional view of an example of a barrier that can be incorporated into the rotating control device.

Referring additionally now to FIG. 3, an enlarged scale cross-sectional view of an example of the barrier 60 is representatively illustrated. In this view, the manner in which the barrier 60 is connected in the FIG. 2 rotating control device 40 can be seen. However, the barrier 60 may be used with other types of rotating control devices in keeping with the principles of this disclosure.

In the FIG. 3 example, the barrier 60 includes an upper portion 62 and a lower portion 64. The upper portion 62 is secured (e.g., with fasteners 36), so that it rotates with the annular seal 42 and the inner mandrel 50. The lower portion 64 is secured (e.g., with fasteners 38), so that it remains stationary with the bearing housing 52.

Any debris or particulates external to the rotating control device 40 must pass through the barrier 60 if it is to contact the rotary seals 56. However, as mentioned above, the barrier 60 is configured to exclude the debris and particulates from contact with the rotary seals 56.

Figure 4:
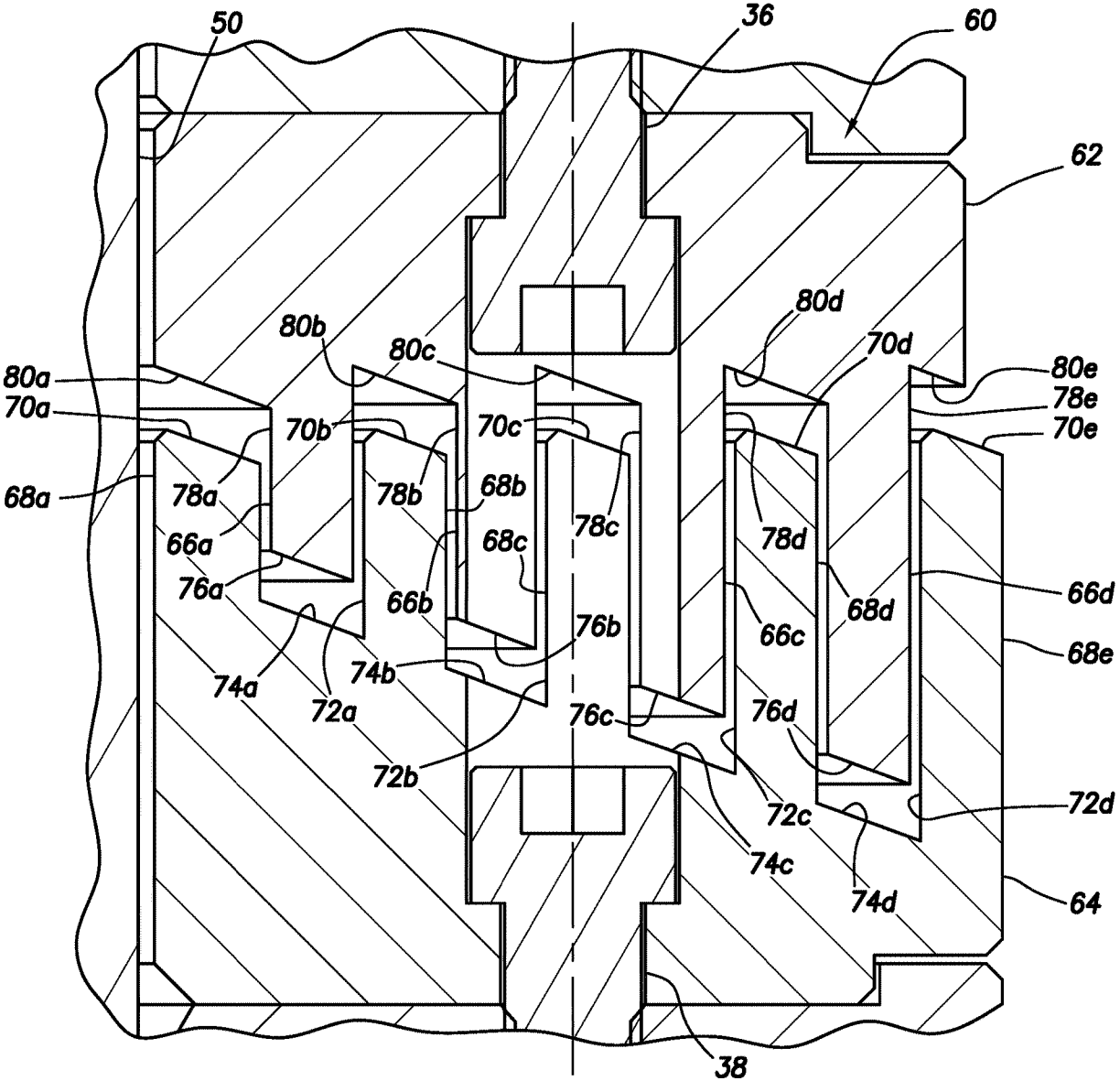
FIG. 4 is a representative cross-sectional enlarged scale view of the example of the barrier.

Referring additionally now to FIG. 4, a further enlarged scale cross-sectional view of the barrier 60 is representatively illustrated. In this view, the manner in which the barrier 60 excludes external debris and particulates can be seen.

Specifically, the upper portion 62 includes multiple downwardly extending concentric annular walls 66*a-d*. The lower portion 64 includes multiple upwardly extending concentric annular walls 68*a-e*. The walls 66*a-d*, 68*a-e* are interdigitated with each other, so that a tortuous path is presented to any external debris or particulates that might migrate radially inward between the upper and lower portions 62, 64 of the barrier 60.

In addition, the barrier 60 makes use of the action of gravity to further inhibit migration of debris or particulates between the upper and lower portions 62, 64, and to expel any debris or particulates that might have partially migrated between the upper and lower portions. Upper surfaces 70*a-e* of the lower portion walls 68*a-e* are inclined downward in the radially outward direction, so that gravity tends to prevent migration of debris or particulates over each of the walls 68*a-e*.

Concentric annular recesses 72*a-d* are formed between respective adjacent pairs of the walls 68*a-e*. Lower surfaces 74*a-d* of the recesses 72*a-d* are inclined downward in the radially outward direction. As described more fully below, the downward inclination of the lower surfaces 74*a-d* aids in expelling any debris or particulates that might have partially migrated inward between the upper and lower portions 62, 64.

The walls 66*a-d* of the upper portion 62 have respective lower surfaces 76*a-d* that are inclined downward in the radially outward direction. Concentric annular recesses 78*a-e* are formed between respective adjacent pairs of the walls 66*a-d*, and internal to and external to the respective innermost and outermost walls 66*a,d*. The recesses 78*a-e* accommodate the lower portion walls 68*a-e* in the upper portion 62, and the recesses 78*a-e* have upper surfaces 80*a-e* that are inclined downwardly in the radially outward direction.

Note that the recesses 72*a-d* formed in the lower portion 64 have depths that progressively increase in the radially outward direction. Similarly, the recesses 78*a-e* formed in the upper portion 62 have depths that progressively increase in the radially outward direction.

The walls 66*a-d* of the upper portion 62 have lengths that progressively increase in the radially outward direction. Similarly, the walls 68*a-e* of the lower portion 64 have lengths that progressively increase in the radially outward direction.

Figure 5:
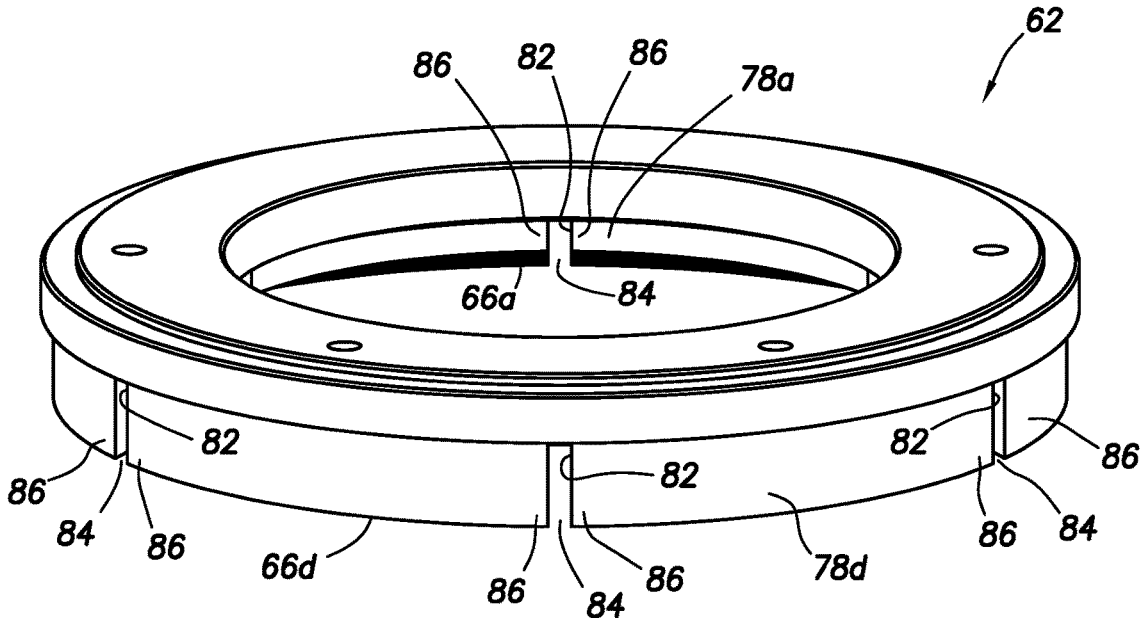
FIG. 5 is a representative perspective view of an upper portion of the barrier.
Figure 6:
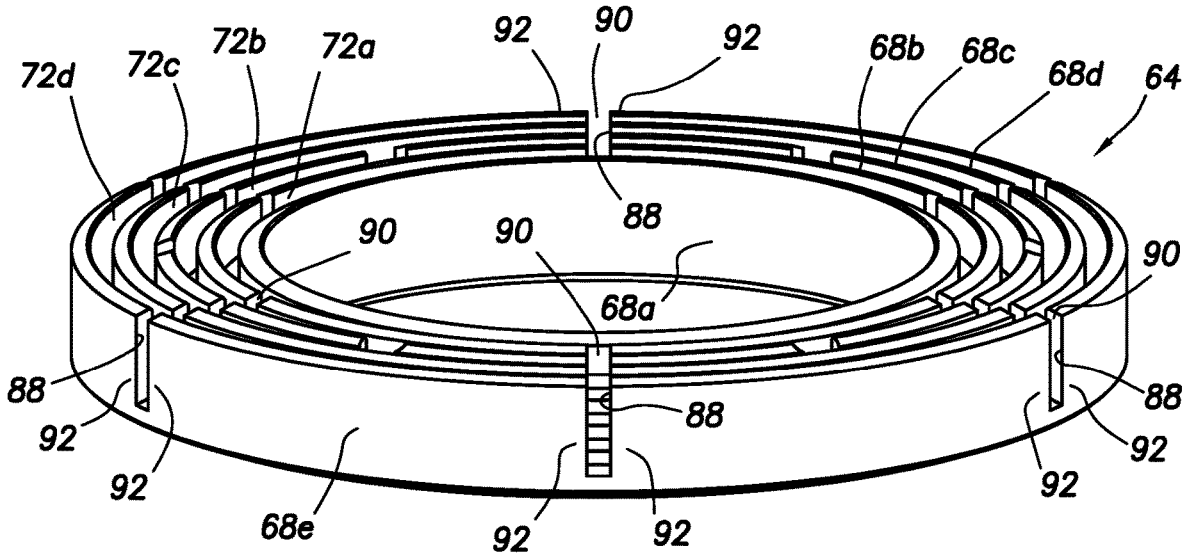
FIG. 6 is a representative perspective view of a lower portion of the barrier.

Referring additionally now to FIGS. 5 & 6, perspective views of the upper portion 62 and the lower portion 64 are representatively illustrated. In these views, the manner in which debris and particulates are expelled from the barrier 60 can be seen.

Radially extending slots 82 are formed through the walls 66*a-d* of the upper portion 62. Gaps 84 are thereby formed between circumferential ends 86 of the walls 66*a-d*.

Radially extending slots 88 are formed through the walls 68*b-e* of the lower portion 64. Gaps 90 are thereby formed between circumferential ends 92 of the walls 68*b-e*. Note that the slots 88 are not formed through the innermost wall 68*a*.

When the slots 82 in the upper portion 62 are rotationally aligned with the slots 88 in the lower portion 64, any debris or particulates between the upper and lower portions 62, 64 can be expelled by the action of gravity from the barrier 60. This process is aided by the downward inclination of the lower surfaces 74*a-d* of the recesses 72*a-d* (see FIG. 4) in the lower portion 64. In addition, repeated alignment and misalignment of the slots 82, 88 as the upper portion 62 rotates relative to the lower portion 64 can act to shred or masticate any larger debris that may have migrated between the upper and lower portions, thereby enabling the debris to be more easily expelled from the barrier 60.

Figure 7:
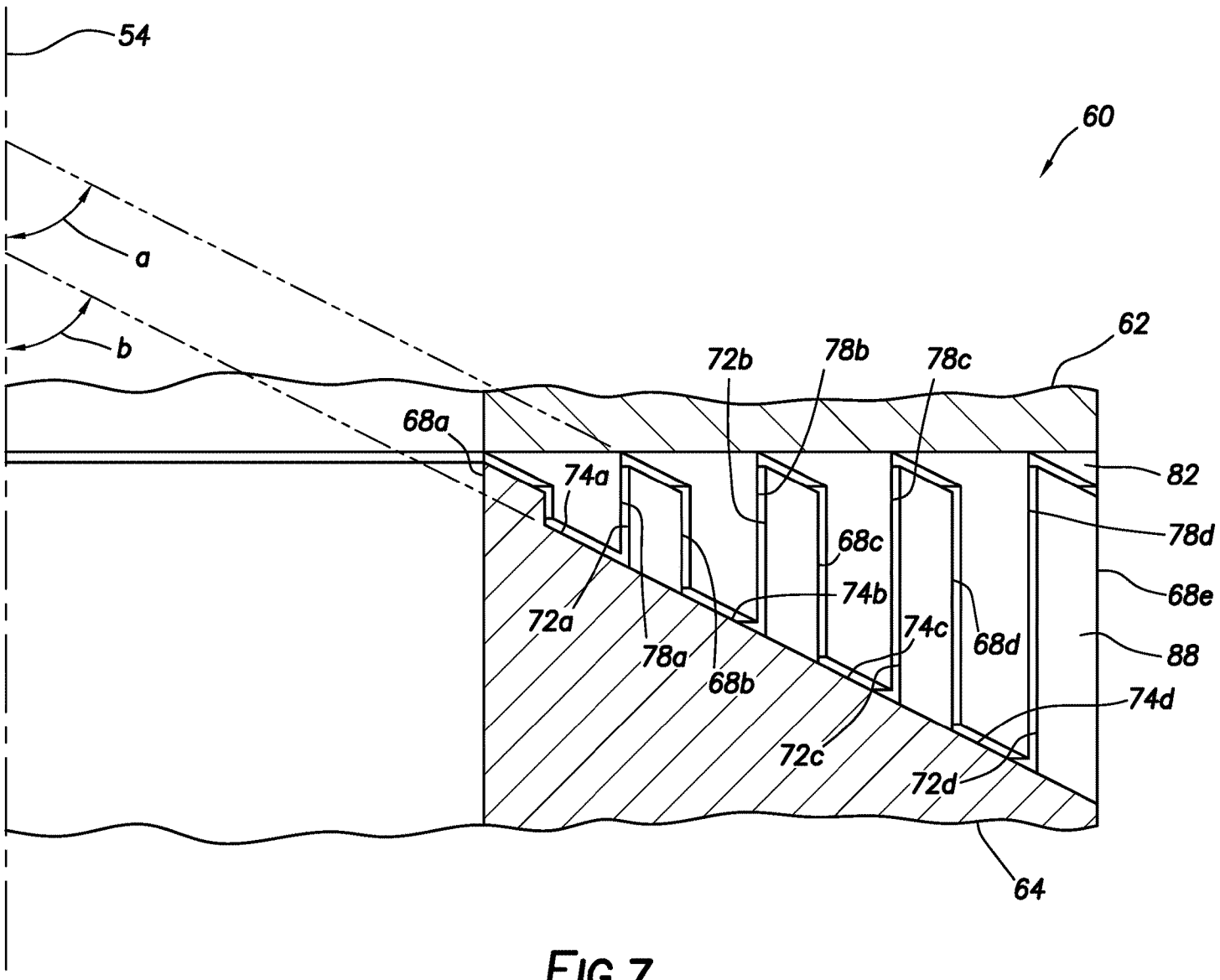
FIG. 7 is a representative cross-sectional view of another example of the barrier.

Referring additionally now to FIG. 7, a cross-sectional view of another example of the barrier 60 is representatively illustrated. The FIG. 7 barrier 60 is similar in most respects to the FIGS. 2-6 barrier, and so the same reference numerals are used in the FIG. 7 example to indicate similar features.

As depicted in FIG. 7, the slots 82, 88 in the upper and lower portions 62, 64 of the barrier 60 are radially aligned. It will, thus, be appreciated that any debris or particulates that may have migrated between the upper and lower portions 62, 64 can fall radially outward by the action of gravity out of the barrier 60 via the aligned slots 82, 88. This radially outward displacement of debris or particulates is facilitated by the downward slope of the lower surfaces 74*a-d* of the recesses 72*a-d*, which also form a lower extent of the slot 88 in this example.

The upper surfaces 70*a-e* of the walls 68*a-e* of the lower portion 64, and the upper surfaces 80*a-e* of the recesses 78*a-e* of the upper portion 62 (see FIG. 4), are inclined downward in the radially outward direction by an angle a relative to the longitudinal axis 54. The lower surfaces 74*a-d* of the recesses 72*a-d* of the lower portion 64, the lower surfaces 76*a-d* of the walls 66*a-d* of the upper portion 62 (see FIG. 4) and the lower extent of the slot 88, are inclined downward in the radially outward direction by an angle b relative to the longitudinal axis 54. Note that the angles a, b are not necessarily the same.

It may now be fully appreciated that the above disclosure provides significant advancements to the art of excluding debris and particulates from rotary seals of a rotating control device. In examples described above, the barrier 60 prevents or at least inhibits radially inward migration of debris and particulates through the barrier.

The above disclosure provides to the art a rotating control device 40 for use with a subterranean well. In one example, the rotating control device 40 can comprise a barrier 60 comprising upper and lower portions 62, 64, the lower portion 64 including multiple annular walls 68*a-e*, and an upper surface 70*a-e* of each wall 68*a-e* being inclined downward in a radially outward direction.

In any of the examples described herein:

Multiple annular recesses 72*a-d* may be formed in the lower portion 64, each of the recesses 72*a-d* being positioned between an adjacent pair of the walls 68*a-e*. The recesses 72*a-d* can have depths in the lower portion 64 that progressively increase in the radially outward direction. A lower surface 74*a-d* of each recess 72*a-d* may be inclined downward in the radially outward direction.

The walls 68*a-e* may be circumferentially discontinuous. Gaps 90 may be formed between circumferential ends 92 of the walls 68*a-e*. A slot 88 may be formed through each of the walls 68*b-e*, except for a radially innermost one of the walls 68*a*.

The upper portion 62 may include multiple annular walls 66*a-d*. The upper portion walls 66*a-d* may be interdigitated with the lower portion walls 68*a-e*. A slot 82 may be formed through each of the upper portion walls 66*a-d*.

The above disclosure also provides to the art a rotating control device 40 which, in one example, comprises a bearing housing 52, an inner mandrel 50 rotatably supported in the bearing housing 52, and a barrier 60 having upper and lower portions 62, 64. The upper portion 62 is secured against rotation relative to the inner mandrel 50, the lower portion 64 is secured against rotation relative to the bearing housing 52, the lower portion 64 includes annular recesses 72*a-d*, and the recesses 72*a-d* are progressively deeper in a radially outward direction.

In any of the examples described herein:

A lower surface 74*a-d* of each recess 72*a-d* may be inclined downward in the radially outward direction. The lower portion 64 may include multiple annular walls 68*a-e*, with each recess 72*a-d* being formed between an adjacent pair of the walls 68*a-e*. An upper surface 70*a-e* of each wall 68*a-e* may be inclined downward in a radially outward direction.

The upper portion 62 may include multiple annular recesses 78*a-e*. An upper surface 80*a-e* of each of the recesses 78*a-e* may be inclined downward in the radially outward direction. The upper portion 62 may include multiple annular walls 66*a-d*. A slot 82 may be formed through each of the upper portion walls 66*a-d*.

One example of a rotating control device 40 described above can comprise a barrier 60 having upper and lower portions 62, 64, the upper and lower portions 62, 64 having annular walls 66*a-d*, 68*a-e*, the upper portion walls 66*a-d* being interdigitated with the lower portion walls 68*a-e*, and the upper and lower portion walls 66*a-d*, 68*a-e* being circumferentially discontinuous. Gaps 84, 90 are formed between circumferential ends 86, 92 of the upper and lower portion walls 66*a-d*, 68*a-e*.

In any of the examples described herein:

Multiple annular recesses 72*a-d* may be formed in the lower portion 64, each of the recesses 72*a-d* may be positioned between an adjacent pair of the lower portion walls 68*a-e*, and the recesses 72*a-d* can have depths in the lower portion 64 that progressively increase in the radially outward direction. A lower surface 74*a-d* of each recess 72*a-d* may be inclined downward in the radially outward direction.

Multiple annular recesses 78*a-e* may be formed in the upper portion 62, each of the recesses 78*a-e* may be positioned between an adjacent pair of the upper portion walls 66*a-d*, and the recesses 78*a-e* can have depths in the upper portion 62 that progressively increase in the radially outward direction.

An upper surface of each of the recesses 78*a-e* may be inclined downward in the radially outward direction. A slot 88 formed through the lower portion walls 68*b-e* may be inclined downward in the radially outward direction.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used. The embodiments are described merely as examples of useful applications of the principles of the disclosure, which is not limited to any specific details of these embodiments.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A rotating control device for use with a subterranean well, the rotating control device comprising:

a barrier comprising upper and lower portions, the lower portion including multiple annular walls, and an upper surface of each wall being inclined downward in a radially outward direction, in which a first slot is formed through each of the walls, except for a radially innermost one of the walls.

2. The rotating control device of claim 1, in which multiple annular recesses are formed in the lower portion, each of the recesses being positioned between an adjacent pair of the walls, and the recesses having depths in the lower portion that progressively increase in the radially outward direction.

3. The rotating control device of claim 2, in which a lower surface of each recess being inclined downward in the radially outward direction.

4. The rotating control device of claim 1, in which the walls are circumferentially discontinuous, and gaps are formed between circumferential ends of the walls.

5. The rotating control device of claim 1, in which the upper portion includes multiple annular walls, the upper portion walls being interdigitated with the lower portion walls.

6. The rotating control device of claim 5, in which a second slot is formed through each of the upper portion walls.

7. A rotating control device for use with a subterranean well, the rotating control device comprising:

a bearing housing;

an inner mandrel rotatably supported in the bearing housing; and a barrier having upper and lower portions, the upper portion being secured against rotation relative to the inner mandrel, the lower portion being secured against rotation relative to the bearing housing, the lower portion including annular recesses, and the recesses being progressively deeper in a radially outward direction, in which the upper portion includes multiple annular walls, and a slot is formed through each of the upper portion walls.

8. The rotating control device of claim 7, in which a lower surface of each recess being inclined downward in the radially outward direction.

9. The rotating control device of claim 7, in which the lower portion includes multiple annular walls, each recess being formed between an adjacent pair of the walls.

10. The rotating control device of claim 9, in which an upper surface of each wall is inclined downward in the radially outward direction.

11. The rotating control device of claim 7, in which the upper portion includes multiple annular recesses, and an upper surface of each of the upper portion recesses is inclined downward in the radially outward direction.

12. A rotating control device for use with a subterranean well, the rotating control device comprising:

a barrier having upper and lower portions, the upper and lower portions having annular walls, the upper portion walls being interdigitated with the lower portion walls, and the upper and lower portion walls being circumferentially discontinuous, whereby gaps are formed between circumferential ends of the upper and lower portion walls, in which a slot formed through the lower portion walls is inclined downward in a radially outward direction.

13. The rotating control device of claim 12, in which multiple annular recesses are formed in the lower portion, each of the recesses being positioned between an adjacent pair of the lower portion walls, and the recesses having depths in the lower portion that progressively increase in the radially outward direction.

14. The rotating control device of claim 13, in which a lower surface of each recess is inclined downward in the radially outward direction.

15. The rotating control device of claim 12, in which multiple annular recesses are formed in the upper portion, each of the recesses being positioned between an adjacent pair of the upper portion walls, and the recesses having depths in the upper portion that progressively increase in the radially outward direction.

16. The rotating control device of claim 15, in which an upper surface of each of the recesses is inclined downward in the radially outward direction.

* * * * *